US011612974B2

(12) United States Patent
Gornay

(10) Patent No.: US 11,612,974 B2
(45) Date of Patent: Mar. 28, 2023

(54) SHARPENING DEVICE

(71) Applicant: SOGEST, Ars sur Moselle (FR)

(72) Inventor: Jean-Luc Gornay, Corny sur Moselle (FR)

(73) Assignee: SOGEST, Ars sur Moselle (FR)

( * ) Notice: Subject to any disclaimer, the term of this patent is extended or adjusted under 35 U.S.C. 154(b) by 789 days.

(21) Appl. No.: 16/482,694

(22) PCT Filed: Jan. 26, 2018

(86) PCT No.: PCT/FR2018/050178
§ 371 (c)(1),
(2) Date: Jul. 31, 2019

(87) PCT Pub. No.: WO2018/142046
PCT Pub. Date: Aug. 9, 2018

(65) Prior Publication Data

US 2020/0001421 A1 Jan. 2, 2020

(30) Foreign Application Priority Data

Feb. 2, 2017 (FR) ..... 17 50890

(51) Int. Cl.
*B24B 3/54* (2006.01)

(52) U.S. Cl.
CPC ..... *B24B 3/54* (2013.01)

(58) Field of Classification Search
CPC ..... B24B 15/08; B24B 3/54
USPC ..... 451/261
See application file for complete search history.

(56) References Cited

U.S. PATENT DOCUMENTS

| | | | | | |
|---|---|---|---|---|---|
| 594,320 | A * | 11/1897 | Bonniwell | B24B 3/54 | 451/511 |
| 2,735,247 | A * | 2/1956 | Holzhausen | B24B 3/54 | 451/438 |
| 2,798,345 | A * | 7/1957 | Spear | B24B 3/54 | 451/178 |
| 2012/0015590 | A1* | 1/2012 | Li | B24B 3/54 | 451/65 |

FOREIGN PATENT DOCUMENTS

| | | | | |
|---|---|---|---|---|
| DE | 191380 A | * | 1/1922 | |
| DE | 191380X | * | 10/1923 | |
| DE | 102010028123 A1 | * | 10/2011 | B24B 23/02 |
| FR | 1271570 A | | 1/1962 | |
| KR | 2013 0088446 A | | 8/2013 | |
| WO | 2007148878 A1 | | 12/2007 | |

* cited by examiner

*Primary Examiner* — Nhat Chieu Q Do
(74) *Attorney, Agent, or Firm* — Craft Chu PLLC; Andrew W. Chu

(57) ABSTRACT

A sharpening device for a blade of a cutting tool, such as a knife or the like, includes at least two flexible discs. Each disc has an abrasive inner face. The discs, abutting with their abrasive faces, face each other and are mounted so as to rotate in the same direction and at the same speed about a same axis. The device includes a pressure mechanism, arranged outside the flexible discs and clamping the discs along a non-diametrical chord, and an inner pressure mechanism for the inside of the discs, so as to exert pressure on the inner faces of the discs, in the parts of same delimited by the chord and not traversed by the axis. The choice of positioning of the inner pressure mechanism relative to the pressure mechanism defines the sharpening angle.

4 Claims, 2 Drawing Sheets

SHARPENING DEVICE

CROSS-REFERENCE TO RELATED APPLICATIONS

The present application is a PCT national stage application under 35 USC 365(c) to PCT/FR18/50178, filed on 26 Jan. 2018, and entitled "SHARPENING DEVICE".

BACKGROUND OF THE INVENTION

1. Field of the Invention

The present invention relates to the field of devices for sharpening blades, in particular knives.

2. Description of Related Art Including Information Disclosed Under 37 CFR 1.97 and 37 CFR 1.98

In a known manner, many machines exist making it possible to sharpen blades. These machines generally have a grinding wheel system with a rotary abrasive strip or abrasive rotary round stone, which rotates and in contact with which one of the faces of the blade to be sharpened is brought.

In practice, the operator alternately applies one of the two faces of the blade to be sharpened against the abrasive strip or the round stone in order to perform the sharpening operation.

These systems have the drawback of requiring the blade to be turned over in order to sharpen one face after the other, which requires the operator to have a certain dexterity and to have a certain experience to keep the blade at the right angle and to obtain the desired sharpening profile.

In order to resolve this problem, sharpening machines have been built having two abrasive strips or round stones that intersect. With these bilateral abrasion systems, the blade becomes positioned between the two strips or the two stones allowing simultaneous sharpening on each of its opposite faces.

Nevertheless, these systems have the drawback of requiring a particular agility of the operator when he can obtain an adequate blade angle corresponding to the use he wishes to make thereof.

To resolve this problem, blade guide systems are used making it possible to wedge and hold the blade during the sharpening operation, and which are placed upstream from bilateral abrasion strips or stones.

Nevertheless, the sharpening machines known from the prior art are not fully satisfactory.

Indeed, the sharpening duration for the users is long; it is around 1 to 3 min. Furthermore, the precision of the sharpening angle has an error risk relative to the initial angle, which can be between 10 and 25%, which is still too high for the users of the blades to be sharpened.

An alternative solution should be found to the existing blade sharpening devices, not having the aforementioned drawbacks and allowing easy sharpening, quick to perform and having a quality and a cutting angle precision greater than that obtained by said existing devices.

BRIEF SUMMARY OF THE INVENTION

The present invention aims to offset the drawbacks of the state of the art, by proposing a device for sharpening a cutting tool blade, of the knife type or the like.

Thus, said device comprises at least two flexible discs each having an abrasive inner face, alongside facing abrasive faces, mounted rotating in a same direction and at the same speed around a same axis; pressing means, arranged outwardly and gripping said discs along a non-diametric chord; and means inside said discs exerting bearing on the inner faces of the discs, in their parts delimited by the chord and not passed through by the axis, the choice of the positioning of said internal means relative to said pressing means defining the sharpening angle.

Furthermore, according to other features of the invention:

- the pressing means consist of an alignment of carrier balls;
- said pressing means consist of two magnets of opposite polarities positioned opposite one another and associated with sliding means arranged in contact with the flexible discs;
- said abrasive inner face consists of an abrasive disc attached and fastened reversibly on the flexible disc;
- the abrasive disc is secured to the flexible disc through a fastening system of the velvet-hook type;
- said internal means exerting bearing on the inner faces of the discs consist of a ball spacer intended to roll on the periphery of the part delimited by the chord and not passed through by the axis of each of the flexible discs.

Advantageously also according to the invention, said device is provided in its upper part with a stair-stepping removable blade guide, able to be positioned between the two parts delimited by the chord and not passed through by the axis of said two flexible discs.

BRIEF DESCRIPTION OF THE SEVERAL VIEWS OF THE DRAWINGS

Other features and advantages of the invention will emerge from the following detailed description of non-limiting embodiments of the invention, in reference to the appended figures, in which.

DETAILED DESCRIPTION OF THE INVENTION

The present invention relates to a sharpening device 1 for a blade 2.

The blade 2 in question is of the knife type or the like, for example a kitchen knife or surgical scalpel.

Figure 1:
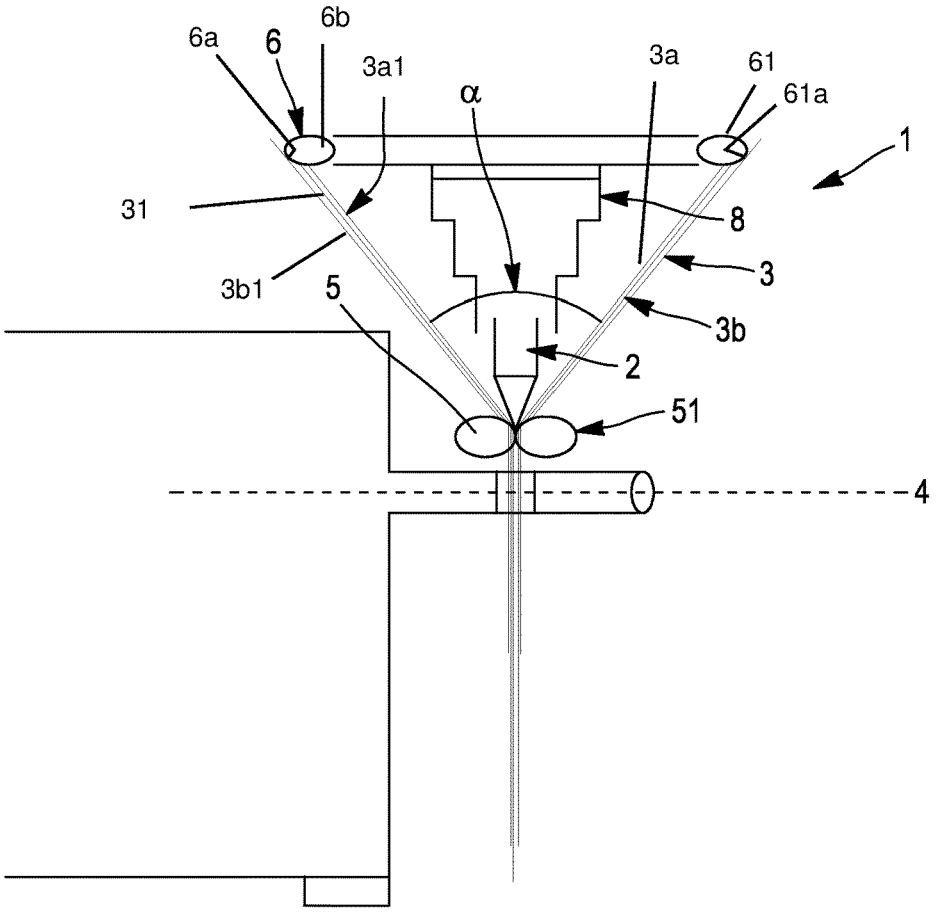
FIG. 1 is a schematic view of a profile sectional view of the sharpening device of the invention.

The device 1 of the invention comprises two flexible discs 3 as shown in FIG. 1.

Advantageously, the flexible discs 3 are made from a material such as plastic, cardboard, flexible steel or the like.

Figure 3A:
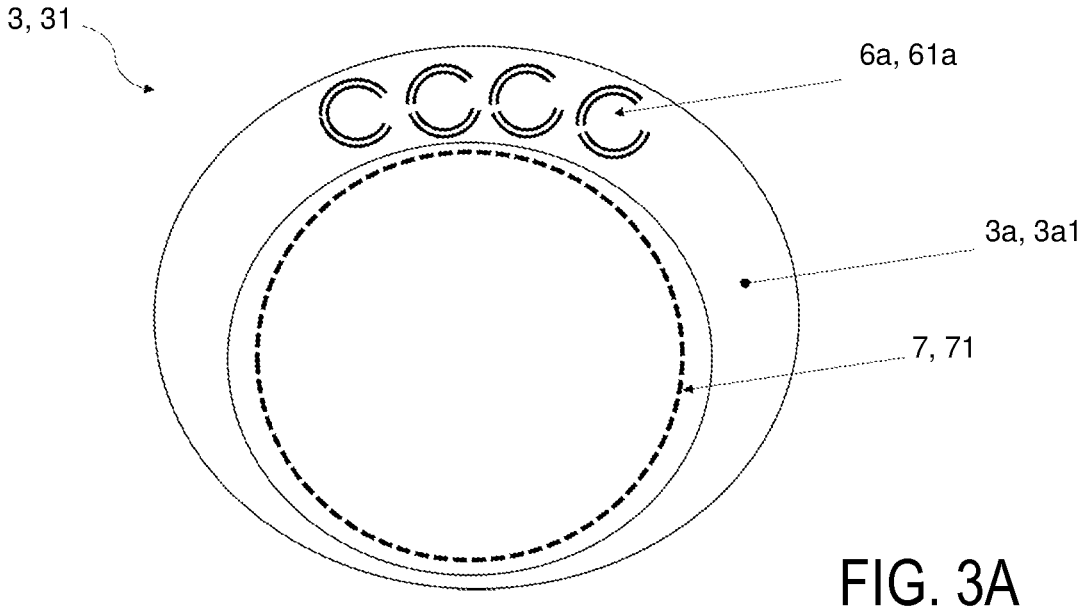
FIGS. 3A and 3B are schematic views of the inner face of the flexible discs in the presence and in the absence of adhesive means supporting the abrasive means.
Figure 3B:
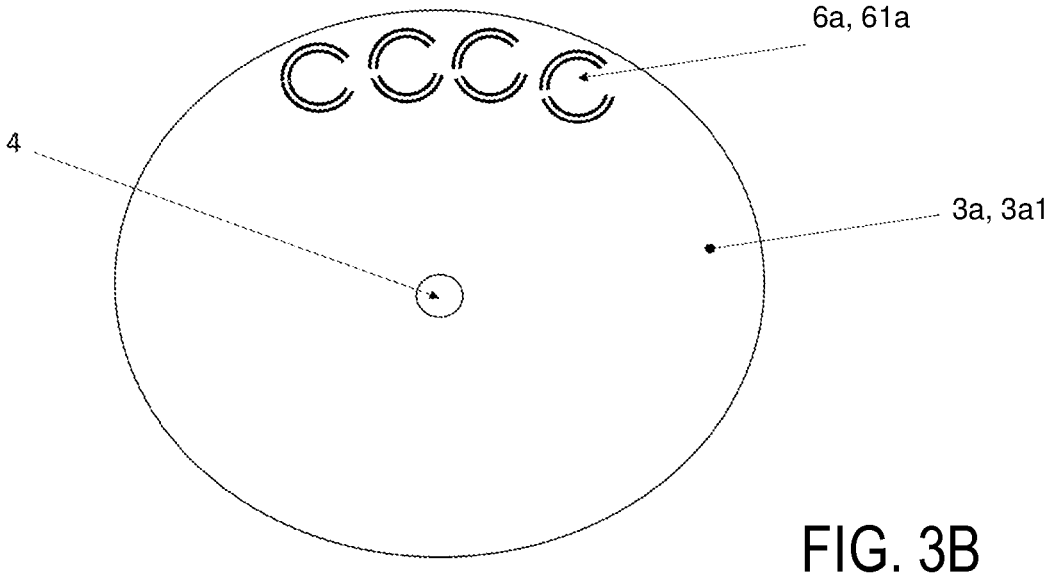

According to the invention, each flexible disc 3 has an inner face 3*a* and an outer face 3*b* as shown by FIGS. 3A and 3B. A first flexible disc 3 has a first abrasive inner face 3*a* and first outer face 3*b* opposite the first abrasive inner face. A second flexible disc 31 having a second abrasive inner face 3*a*1 and second outer face 3*b*1 opposite the second abrasive inner face.

The inner face 3*a* is abrasive and serves to sharpen said blade 2. The first abrasive inner face 3*a* faces the second abrasive inner face 3*a*1 so as to form a sharpening angle for the blade 2.

According to one preferred embodiment of the invention, the inner face 3*a* for example consists of an abrasive disc 7 attached and fastened reversibly on said flexible disc 3. The first abrasive disc 7 can be attached to the first flexible disc 3, and a second abrasive disc 71 can be attached to the second flexible disc 31, respectively.

Preferably, said abrasive disc 7 has a particle size of between 8 and 5000 nm.

Preferably, said abrasive disc 7, also flexible, is secured to the flexible disc 3 through a fastening system of the hook and loop type.

Nevertheless, any other reversible fastening means known from the prior art is possible, such as a double-sided adhesive, a pull-tab system, press button or a magnetized system.

As shown in FIG. 1, the two flexible discs 3 are alongside one another and mounted such that their abrasive faces are facing one another.

According to the invention, said flexible discs 3 are mounted rotating about a same axis 4.

According to a first embodiment, the two flexible discs 3 are mounted fixed on a same axle shaft 4 rotated by a motor.

According to a second embodiment, not shown, each of the flexible discs 3 is mounted at the end of a shaft rotated by a motor, the two shafts being coaxial, and are driven in the same direction and at the same speed by a single motor means or by several synchronized motor means.

Thus, irrespective of the considered embodiment, during the operation of the device 1 according to the invention, when the motor means are activated, the flexible discs 3 rotate together, in the same direction and at the same speed while having their abrasive inner faces alongside one another.

Figure 2:
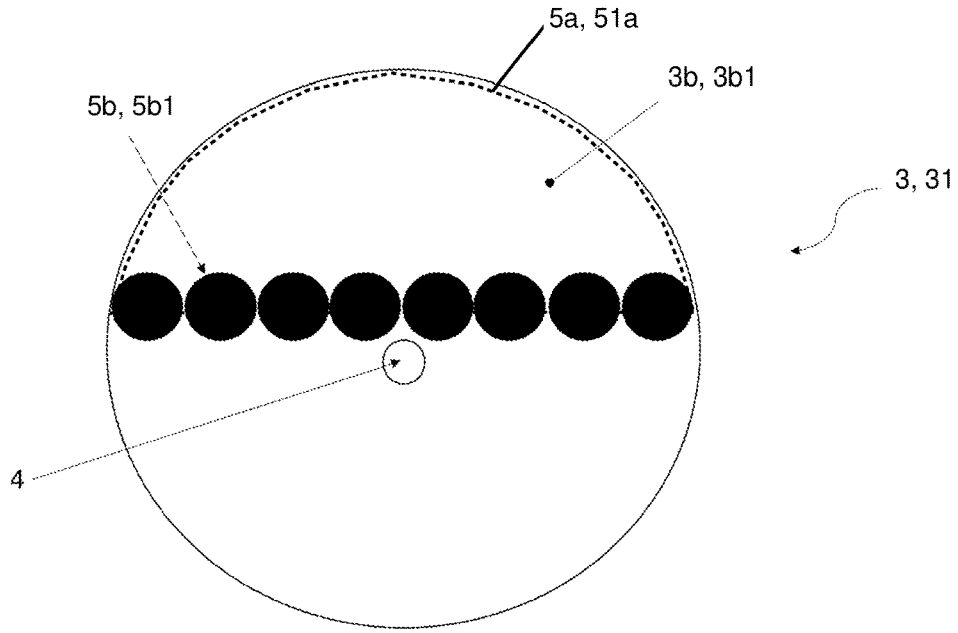
FIG. 2 is a front schematic view of the outer face of the flexible discs.

According to the invention, said sharpening device also comprises pressing means 5 arranged outwardly, i.e., cooperating directly with the outer face 3*b* of said flexible discs 3. Said pressing means 5 are linear and grip said at least two flexible discs 3 between them along a non-diametric chord of said flexible discs 3 as shown in FIG. 2. A first pressing means 5 is against the first outer face of the first flexible disc along a first non-diametric chord so as to form a first chord portion 5*a*. A second pressing means 51 is against said second outer face of said second flexible disc along a second non-diametric chord so as to form a second chord portion 51*a*. The second non-diametric chord is aligned with the first non-diametric chord.

In other words, the linear pressing means 5 define a chord on said flexible disc 3, said chord not passing through the axis 4.

According to one privileged embodiment visible in FIGS. 1 and 2, said pressing means 5 consist of an alignment of carrier balls (a first plurality 5*b* of carrier balls and a second plurality 5*b*1 of carrier balls).

During the operation of the device 1, when said flexible discs 3, 31 are rotatable, the carrier balls 5*b*, 5*b*1 guarantee the pinching of the two discs 3, 31 along a line, their possible rotation performing an anti-friction function.

According to another embodiment, not shown, the pressing means 5 consist of two magnets of opposite polarities positioned opposite one another and associated with sliding means arranged in contact with the flexible discs 3, 31.

According to still another embodiment, not shown, the pressing means 5 consist of two single bars in a half-moon shape made from ceramic or steel, for example.

According to one additional embodiment, not shown, the pressing means 5 consist of an air pressing system.

The sharpening device 1 also comprises internal means 6 exerting bearing on the inner faces 3*a* of the flexible discs 3. Said internal means 6 of said discs 3 act by bearing in the part 30 of the discs 3 delimited by the chord and not passed through by the axis 4 as shown in FIGS. 1 and 3A.

In other words, said internal means 6, by exerting bearing on the inner faces 3*a* of said discs 3, generate a separation of said discs 3 that are alongside one another. The choice of the positioning of the bearing on the discs by the internal means 6 relative to the pressing means 5 defines a sharpening angle $\alpha$ as shown in FIG. 1. A first bearing means 6 is against a first bearing portion 6*a* of the first abrasive inner face 3*a* of the first flexible disc 3 corresponding to the first chord portion 5*a* on the first outer face 3*b*. A second bearing means 61 is against a second bearing portion 61*a* of the second abrasive inner face 3*a*1 of the second flexible disc 31 corresponding to the second chord portion 5*a*1 on the second outer face 3*b*1, In the space delimited by the separation of the two discs 3, the blade 2 is introduced in order to position it between the two rotating flexible discs 3; the angle $\alpha$ is that chosen as a function of the blade characteristics 2, which, during the sharpening operation, will make it possible to sharpen this blade 2. The first pressing means, the first chord portion, the first bearing means on the first bearing portion, second pressing means, the second chord portion, and the second bearing means on the second bearing portion, form the sharpening angle between the first flexible disc and the second flexible disc.

According to one particular embodiment, said internal means 6 exerting bearing on the inner faces 3*a* of the discs 3 consist of a ball spacer 6*b* intended to roll on the periphery of the part delimited by the chord and not passed through by the axis of each of the flexible discs 3, as shown in FIGS. 3A and 3B.

In this embodiment, during the sharpening operation, during the rotation of the flexible discs 3, the balls of the spacer will roll against the inner faces 3*a* of said two discs 3 that are alongside one another to keep them separated in order to leave a passage for insertion of the blade 2 to be sharpened, said passage corresponding to the sharpening angle.

Advantageously, in order to facilitate the insertion of the blade 2 into the sharpening angle, the device 1 in its upper part [sic] with a removable blade guide 8, preferably staircase-shaped as shown in FIG. 1.

Said blade guide 8 is able to be positioned between the two parts 3*a* of each of the two flexible discs 3. In other words, said blade guide 8 is positioned at the sharpening angle as shown in FIG. 1.

According to one particular embodiment, said device 1 according to the invention includes two pairs of flexible discs 3 each connected to an axle shaft 4 actuated in rotation by a same motor, thus it is possible to sharpen two blades with the same device and at the same time.

The present invention has the advantage of facilitating the blade sharpening that one wishes to sharpen at a precise angle. More specifically, the use of the device 1 according to the invention makes it possible to:

- increase the precision of the sharpening angle, the angle error risk of which is at most between 0.1 and 0.2%,
- increase the sharpening speed, the sharpening is fast, approximately from 15 to 20 seconds versus 2 to 3 minutes with the devices of the prior art;
- increase the longevity of the sharpness retention of the sharpened blades;

have an equal and equivalent angle on both faces of the sharpened blade.

The other advantage of the device 1 of the invention consists of its ease of use, which does not require special diligence by the operator to position the blade within the sharpening angle of the device 1. The sharpening angle being created by the positioning of the pressing means 5 relative to the internal means 6, the two faces of the blade 2 to be sharpened are sharpened simultaneously and at the same time, resulting in a better sharpening quality and angle precision than that obtained with the devices of the state of the art.

The blades 2 obtained by using the device 1 therefore have a superior cutting quality and longevity compared to that obtained in the prior art, even if a sharpening operation is performed by a user who is not a trained expert.

I claim:

1. A sharpening device for sharpening a cutting tool blade, the device comprising:

a first flexible disc having a first abrasive inner face and a first outer face opposite said first abrasive inner face;

a second flexible disc having a second abrasive inner face and a second outer face opposite said second abrasive inner face, wherein said first abrasive inner face faces said second abrasive inner face so as to form a sharpening angle, wherein said first flexible disc is rotatably mounted on an axis in a first direction at a first speed, and wherein said second flexible disc is rotatably mounted on said axis in said first direction at said first speed;

a first pressing means against said first outer face of said first flexible disc along a first non-diametric chord so as to form a first chord portion;

a second pressing means against said second outer face of said second flexible disc along a second non-diametric chord so as to form a second chord portion, said second non-diametric chord being aligned with said first non-diametric chord;

a first bearing means against a first bearing portion of said first abrasive inner face of said first flexible disc corresponding to said first chord portion; and a second bearing means against a second bearing portion of said second abrasive inner face of said second flexible disc corresponding to said second chord portion, wherein said first pressing means, said first chord portion, said first bearing means on said first bearing portion, said second pressing means, said second chord portion, and said second bearing means on said second bearing portion, form said sharpening angle between said first flexible disc and said second flexible disc.

2. The sharpening device, according to claim 1, wherein said first pressing means comprises a first plurality of carrier balls, and wherein said second pressing means comprises a second plurality of carrier balls aligned with said first plurality of carrier balls.

3. The sharpening device, according to claim 1, further comprising:

a first abrasive disc removably attached to said first flexible disc.

4. The sharpening device, according to claim 1, further comprising, a stair-stepping removable blade guide positioned between said first chord portion and said second chord portion.

* * * * *